US005600900A

United States Patent [19]

Marschke

[11] Patent Number: 5,600,900

[45] Date of Patent: Feb. 11, 1997

[54] VACUUM ASSISTED WEB DRYING SYSTEM

[75] Inventor: Carl R. Marschke, Phillips, Wis.

[73] Assignee: Marquip, Inc., Phillips, Wis.

[21] Appl. No.: 424,994

[22] Filed: Apr. 19, 1995

[51] Int. Cl.[6] ..... F26B 3/32

[52] U.S. Cl. ..... 34/519; 34/92

[58] Field of Search ..... 34/114, 115, 92, 34/519, 624, 635

[56] References Cited

U.S. PATENT DOCUMENTS

| | | | |
|---|---|---|---|
| 3,349,222 | 10/1967 | Johnston . | |
| 3,659,348 | 5/1972 | Frank | 34/122 |
| 4,316,761 | 2/1982 | Hirakawa et al. . | |
| 4,324,613 | 4/1982 | Wahren | 162/111 |
| 4,337,884 | 7/1982 | Hirakawa et al. . | |
| 4,481,066 | 11/1984 | Hirakawa et al. . | |
| 4,788,779 | 12/1988 | Sparkes | 34/117 |

*Primary Examiner*—Henry A. Bennett
*Assistant Examiner*—Dinnatia Doster
*Attorney, Agent, or Firm*— Andrus, Sceales, Starke & Sawall

[57] ABSTRACT

A system providing wrinkle-free drying of a liquid zone coating applied to a paper web includes a surface of high thermal conductivity heated to a uniform temperature above the boiling point of the coating liquid and over which the web is drawn with the uncoated face in contact with the surface. A vacuum is also drawn through the surface to hold the web in intimate contact therewith during drying. The method and apparatus of the invention are applicable to unitary webs as well as composite webs such as corrugated paperboard.

5 Claims, 2 Drawing Sheets

FIG. 1
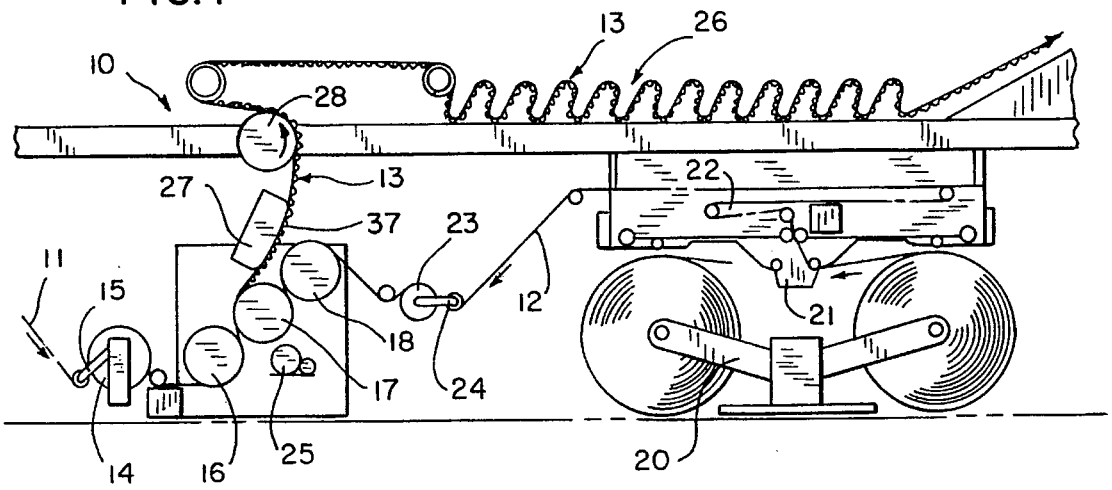
FIG. 2
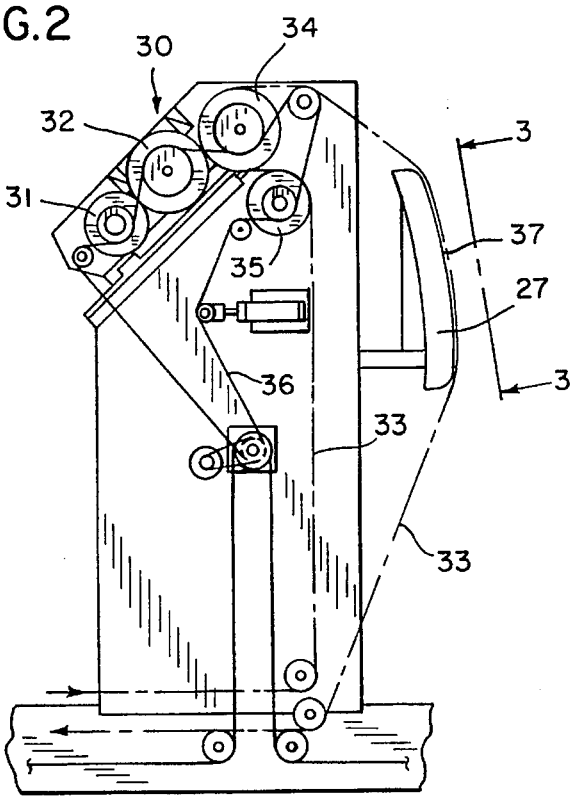
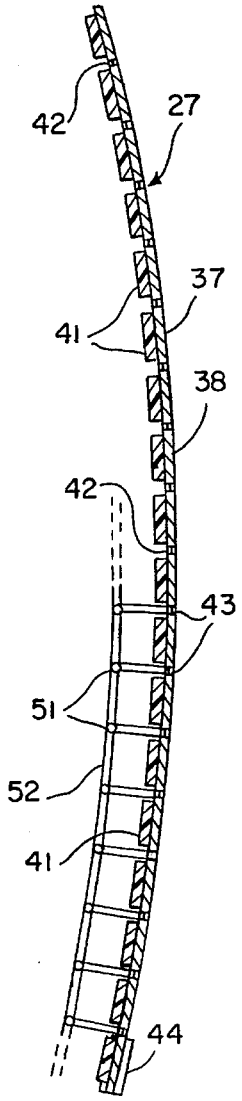
FIG. 4

FIG. 3
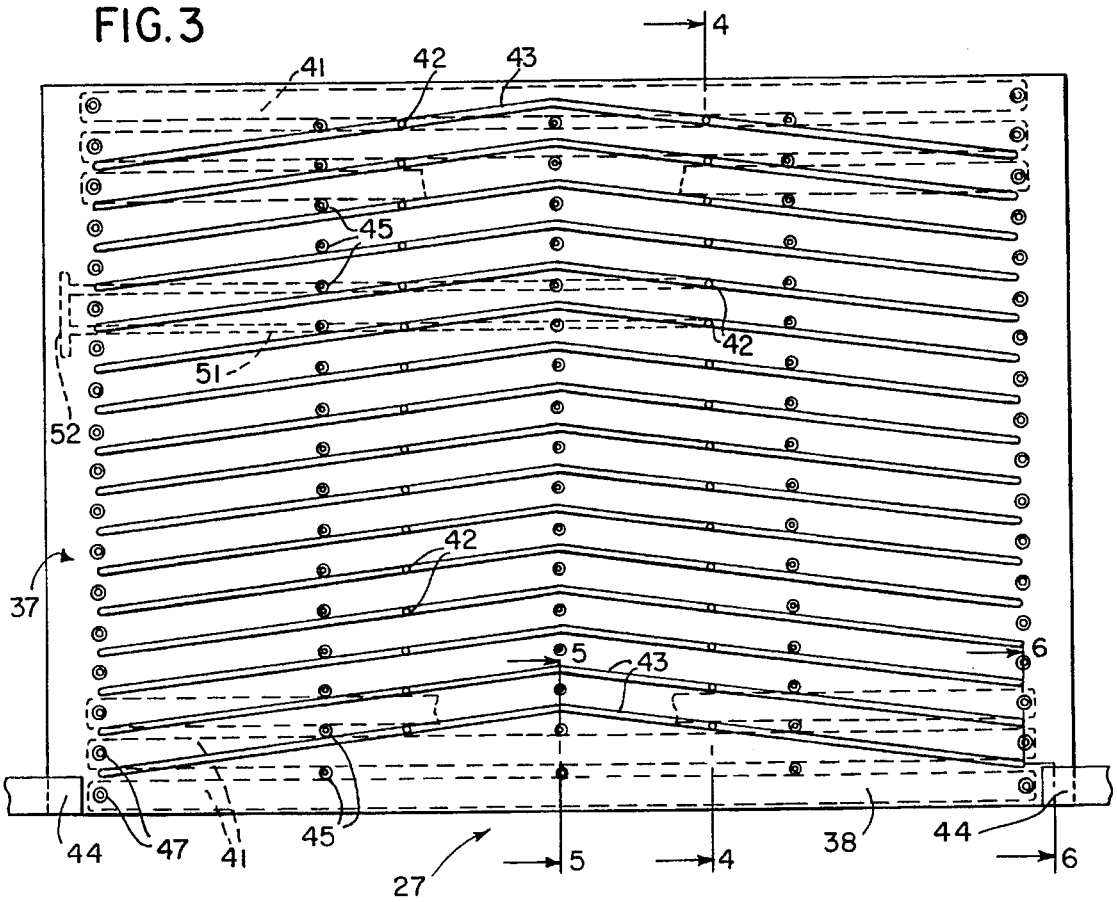
FIG. 5
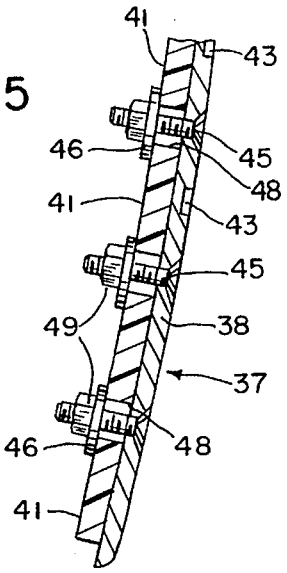
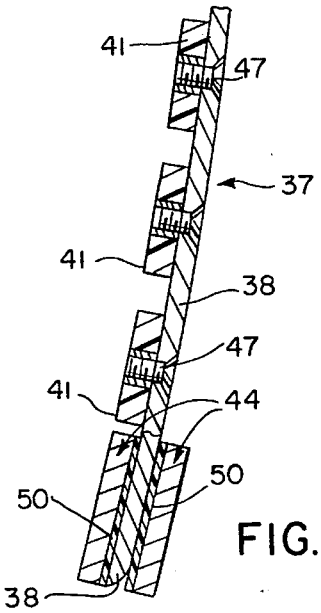
FIG. 6

VACUUM ASSISTED WEB DRYING SYSTEM

BACKGROUND OF THE INVENTION

The subject invention pertains to drying paper webs to which a liquid coating has been applied and, more particularly, to drying aqueous-based zone coatings applied to a traveling paper web.

Paper webs are treated with a wide variety of liquid coatings for various purposes. The coatings may be aqueous-based or utilize some other liquid base. The coatings may be applied to provide a protective layer, an adhesive layer, a printed indicia, or a decorative coating. When the coatings are applied in zones, i.e. covering less than the entire face of the web, there is inevitably a differential penetration of the liquid coating vehicle into the coated portions of the web as opposed to the portions which are not coated. With a water-based coating vehicle, moisture penetration into the paper causes the fibers to swell and the resultant expansion often causes wrinkling of the web. Subsequent drying of the coated web may leave permanent wrinkles or result in curling of the paper products formed from the web. For example, in the production of corrugated paperboard in which two or more paper webs are glued together with a water base starch adhesive, the ever-present problem of moisture control is acutely apparent in the zone coated adhesive which is selectively applied to the flute tips of the corrugated medium and similarly transferred to the liner web with which the medium is combined. Even in the coating of a unitary web, for example applying continuous longitudinally extending, laterally spaced zone coats of an aqueous based coating material to a running paper web, moisture penetration into the paper often results in differential expansion and permanent wrinkling which remains when the web is subsequently dried.

In the manufacture of single face corrugated paperboard, in addition to problems directly associated with moisture variations and differential expansion, it has always been a challenge in the prior art to effect an adequate bond without crushing or unacceptably distorting the flutes of the corrugated medium. The water-based starch adhesive typically used in corrugating is a thermosetting adhesive requiring relatively high temperatures, in the range of 180°–200° F. (82°–93° C.), to cause gelatinization of the starch adhesive. In a conventional single facer, the adhesive is applied by a glue roll to the flute tips on one face of the corrugated medium while the medium is still on one of a pair of corrugating rolls. The liner web is immediately thereafter brought into contact with the coated flute tips by a pressure roller which holds the medium against the flute tips supported from behind by the corrugating roll. As indicated, the liner web, as well as the corrugated medium, are preheated and, in combination with the pressure provided by the pressure roll, causes gelatinization and curing of the adhesive.

Operative contact between the pressure roll and the corrugating roll (with the single face web running therebetween) results in vibration and noise as the pressure roller passes intermittently from tip to tip of the fluted corrugating roll. The problem is aggravated by the high pressure used to hold the liner web against the fluted medium in the nip between the pressure roll and the corrugating roll. Attempts have been made to eliminate this problem by utilizing stationary pressure members which have an arcuate surface corresponding generally to the flute tip diameter of the corrugating roll. Such stationary pressure members are shown, for example, in U.S. Pat. Nos. 4,337,884 and 4,481,066. A similar pressure member, but which includes a belt moving over the arcuate surface thereof, is shown in U.S. Pat. No. 4,316,761. Although the foregoing patents address the problem of vibration and noise, they still require a high nip pressure which can result in flute damage and, furthermore, requires significantly more power to pull the web through the single facer. Such a single face web drive is shown for example in the above identified U.S. Pat. No. 4,481,066, which utilizes a vacuum-assisted drive belt to pull the single face web through the single facer. It is also known to use a pair of opposed belt conveyors to capture the glued single face web therebetween to pull the web through the single facer. The latter apparatus, however, may subject the fluted medium to undesirable crushing loads.

Thus, prior art single facers typically utilize means to preheat the component webs to a relatively high temperature, and a high pressure nip means to effect the starch-based adhesive bond between the medium and the liner. Once the single face web leaves the nip between the corrugating roll and the pressure roll or pressure member, treatment of the web is completed and, if the web is to be used to make a double face corrugated web, the single face web is directed into an accumulating bridge storage device, as is well known in the art.

SUMMARY OF THE INVENTION

The present invention provides an apparatus and method for drying liquid coatings which have been applied to webs, particularly zone coatings which result in significant variations in moisture content along or across the web and resultant difficulties in uniform drying. The method and apparatus of the present invention are applicable to unitary webs as well as composite webs such as corrugated paperboard webs.

In accordance with the present invention, a method and apparatus are provided to attain wrinkle-free zone coatings in running paper webs. In accordance with the method of the present invention, a running paper web, to one face of which a zone coat of a paper-penetrating liquid coating has been applied, is dried by utilizing the steps of: providing a surface of high thermal conductivity in contact with the uncoated face of the web; providing the surface with apertured areas that are in communication with the web face opposite the zone coat; moving the web over the surface; and, heating the surface and simultaneously applying a vacuum to the apertured areas sufficient to dry the liquid coating and prevent wrinkling of the web.

The method is particularly adapted to drying aqueous-based web coatings wherein the heating step provides a surface temperature greater than 100° C. When applying the method to drying a single face corrugated paperboard web, which comprises a liner and a corrugated medium with a coating comprising an adhesive joining the liner and medium, the method includes the steps of positioning the heating surface downstream of the point of joining said liner and medium, and moving the web over the surface with the liner in contact therewith.

The apparatus of the present invention includes a web supporting surface of high thermal conductivity, means for moving the web over the surface with the uncoated web face in contact therewith, means for heating the surface to a generally uniform temperature above the boiling point of the coating liquid, and means for drawing a vacuum through the surface to hold the web in uniform contact therewith during drying. In the presently preferred embodiment, the web supporting surface comprises a stationary plate and the heating means preferably comprises induction heating devices mounted in direct contact with the underside of the plate. The vacuum means includes an array of apertures in the plate which provide open communication between the web supporting surface and the underside of the plate, and a source of vacuum operatively connected on the underside of the plate to the aperture array. The array of apertures preferably forms a pattern of parallel V-shaped aperture groups which open in the direction of web travel. Shallow grooves may be formed in the supporting surface, each of which grooves connects the apertures defining one aperture group.

BRIEF DESCRIPTION OF THE DRAWINGS

FIG. 1 is a schematic side elevation view of a single facer for the production of single face corrugated paperboard utilizing the apparatus of the present invention.

FIG. 2 is a schematic side elevation view of a flexographic printing/coating apparatus also utilizing the apparatus of the present invention.

FIG. 3 is an enlarged top plan view of the web-supporting surface of the web drying apparatus of the present invention as viewed generally on line 3—3 of FIG. 2.

FIG. 4 is a sectional view through the apparatus of FIG. 3 taken on line 4—4 thereof.

FIG. 5 is a partial sectional view taken on line 5—5 of FIG. 3.

FIG. 6 is a partial sectional view taken on line 6—6 of FIG. 3.

DETAILED DESCRIPTION OF THE PREFERRED EMBODIMENTS

In FIG. 1, a single facer 10 operates to adhesively join a liner web 11 to a corrugated medium web 12 to form a composite single face web 13. The liner web 11 is typically delivered from a supply roll (not shown), through a splicer and into a web takeup mechanism, from which it passes over the cylindrical drum of a liner preheater 14 where the amount of wrap of the web on the drum may be varied by adjusting the position of a pivotal wrap arm 15, all in a manner well known in the art. From the preheater 14, the liner web 11 passes between a pressure roll 16 and the lower one 17 of a pair of corrugating rolls 17 and 18.

In a manner similar to the liner web 11, the medium web 12 travels from a roll stand supply 20, through a splicer 21 and takeup mechanism 22 to a web preheater or preconditioner 23 upon which the web 11 may be wrapped by a selected amount depending on the position of the pivotal wrap arm 24. From the preconditioner 23, the medium web 12 passes between the corrugating rolls 17 and 18 which provide the web with the well known corrugated or fluted configuration characteristic of a corrugated paperboard medium. The corrugating rolls operate to substantially compress the length of the medium web 12 and one or both corrugating rolls may include a vacuum source communicating with the roots of the flutes in the roll to hold the corrugated medium 12 in place. One or both of the corrugating rolls 17 and 18 may also be heated, as is well known in the art. A glue applicator 25 is positioned to apply a water-base starch adhesive to the tips of the corrugations or flutes on one side of the corrugated medium web 12 as it passes around the lower corrugating roll 17. The corrugated medium web 12 and the liner web 11 pass between the nip formed by the lower corrugating roll 17 and the pressure roll 16 to bring the liner web into contact with the adhesive coated flute tips of the medium web. The resultant composite single face web 13 exits the nip.

In a typical prior art single facer, the pressure roll 16 is positioned with respect to the tips of the fluted lower corrugating roll 17 a distance less than the thicknesses of the two webs 11 and 12 and layer of adhesive therebetween. The high pressure provided by the nip between the rolls, along with the heat from the rolls and the heat previously applied to the web, causes the starch adhesive to gelatinize and form a permanent bond. In a conventional corrugator where the single face web 13 is to be combined with a second liner web to form a double face corrugated web, the single face web is drawn through the single facer 10 and deposited into an accumulating storage bridge 26 which provides a variable take up for the downstream double facer (not shown). Prior art single facers utilizing high nip pressure between the pressure roll 16 and corrugating roll 17 are subject to the problems and deficiencies described above.

In accordance with the present invention, the pressure roll/corrugating roll nip is operated at very low or virtually no pressure, just sufficient to provide a preliminary uncured bond between the liner 11 and medium 12, with the adhesive bond cured in a downstream vacuum dryer 27 which is the subject of the present invention. The vacuum dryer 27 provides a high temperature drying surface over which the single face web 13 is drawn from the nip and to which a vacuum is also applied to maintain flatness in the liner web and prevent wrinkling. The single face web 13 is preferably pulled through the single facer and across the surface of the vacuum dryer 27 by a driven traction roll 28 with the liner web 11 in contact therewith. Preferably, the traction roll 28 also includes a vacuum assist to supplement the friction drive of the traction roll. The completed single face web is then directed into the storage bridge 26.

Referring also to FIG. 2, the vacuum dryer 27 of the present invention can also be advantageously applied to dry the coating on a paper web processed in a flexographic printer or roll coater 30. In accordance with a conventional construction, the printer 30 includes an ink transfer or anilox roll 31 onto the surface of which a film of liquid coating material, which may be ink, adhesive or other fluid, is applied in a well known manner utilizing, for example, an ink supply reservoir and doctor blade (not shown). The liquid coating on the anilox roll 31 is transferred directly to the cylindrical face of a counterrotating print roll 32 which may comprise, for example, a rubber covered roll having embossed thereon the desired pattern to be transferred onto the paper web 33. The print roll 32 is positioned immediately adjacent a counterrotating backing roll 34 and the paper web 33 is fed between the nip formed by the contacting surfaces of the print roll 32 and backing roll 34 with the pattern being transferred to the web from the print roll. Each of the rolls 31, 32 and 34 may be driven along with a web in-feed roll 35 by a common continuous drive belt 36. The web 33 is fed over the surface of the in-feed roll 35, through the print nip between rolls 32 and 34, and from which it travels directly over the surface of the vacuum dryer 27.

Referring also to FIGS. 3–6, a presently preferred embodiment of the vacuum dryer 27 includes an outer drying surface which is curved in the direction of web travel and may have a width, in the cross machine direction, as wide as necessary to accommodate the width of the web being processed. Thus, a typical 48 inch (122 cm) web would require a slightly wider drying surface. The length of the drying surface 37, in the machine direction, may be varied as required to provide the desired drying characteristics. Alternately, a series of vacuum dryers 27 the combined lengths of the surfaces of which provide the desired drying capacity may also be utilized. In the example shown in FIGS. 3 and 4, the drying surface may have a length of about 36 inches (91 cm).

The drying surface 37 preferably comprises a smooth metal plate of high thermal conductivity, for example a ¼ inch (6 mm) copper sheet 38. The copper sheet 38 is supported in a manner which will retain its fixed position yet allow the sheet to expand and contract under the influence of large temperature variations. One suitable means of supporting the drying surface 37 is shown in FIGS. 3 and 6. Each of the four corners of the copper sheet 48, which comprises the drying surface, is supported in a slotted support block 44. Each of the blocks 44 which may, in turn, be suitably attached to the machine frame, includes a longitudinal slot 48 into which the edge of the copper sheet 38 is inserted and held firmly by upper and lower insulating layers 50. The sheet 38 is held firmly, yet allowed to move under the influence of thermal expansion and contraction in the slotted supports. A series of strip-like induction heaters 41 are mounted to the underside of the copper sheet 38 within the housing 40. Each of the heaters 41 is attached to the underside of the copper sheet with a pair of flat head machine screws 47 extending through the copper sheet 38 into tapped holes in opposite ends of the heater. The induction heater strips 41 are held in position between their opposite ends by groups of three flat head machine screws 45, each of which groups is aligned between an adjacent pair of heater strips 41, each screw extending through a suitable countersunk hole in the surface of the copper sheet 38, and carries at its opposite end a holddown washer 46 secured with a nut 49. The washer spans the gap between the adjacent heaters 41 and bears on the adjacent edges thereof to hold them in position.

A series of vacuum aperture pairs 42 are formed through the copper surface sheet 38 to provide open communication between the underside of the sheet and the drying surface 37. A shallow V-shaped vacuum groove is formed in the surface of the copper sheet 38 for each pair of vacuum apertures 42. The vacuum grooves are parallel to one another and, in combination, form a sort of chevron pattern in the drying surface 37 as shown in FIG. 3. The chevron pattern of the vacuum grooves 43 is oriented so that the bottom of the Vs point in an upstream direction with respect to web movement (or open in the downstream direction). Each pair of vacuum apertures 42 is connected to a vacuum lateral 51 which extends to one lateral edge of the drying surface 37 beneath the copper sheet 38. Each of the vacuum laterals 51 is, in turn, connected to a vacuum header 52 to which a vacuum source (not shown) is operatively connected.

In operation, the heaters 41 are utilized to heat the copper sheet 38 to a high uniform surface temperature of, for example, 350° F. (195° C.), and simultaneously, a vacuum is applied to the surface and is also uniformly distributed thereover through the vacuum grooves 43. The result is the rapid and uniform drying of zone coated webs without wrinkling or warping, including a single face corrugated web 13 or a unitary paper web 33 to which laterally or longitudinally spaced coatings have been applied. In the case of a water-base coating, such as an adhesive starch used to bond the single face web 13, the uniformly heated drying surface 37 will heat the liner web 11, between the lines of contact with the adhesive coated flute tips of the corrugated medium web 12, to approximately the same high temperature. However, the temperature of the liner web 11 where the water-base adhesive has been applied, as well as the temperature of the adhesive and the flute tips of the corrugated web, remains substantially lower because of the presence of the moisture. The high conductivity copper surface allows the heat to readily transfer into the cooler zones wetted by the adhesive to provide a rapid and uniform drying and curing thereof. During drying movement of the web over the drying surface 37, the application of vacuum through the apertures 42 and connecting grooves 43 effectively prevents wrinkling and warping of the liner web 11 which would otherwise have a tendency to occur because of differential expansion in the wetted zones and resultant non-uniform drying.

Various modes of carrying out the present invention are contemplated as being within the scope of the following claims particularly pointing out and distinctly claiming the subject matter which is regarded as the invention.

I claim:

1. An apparatus for drying a traveling paper web to one face of which a zone coat of a paper-penetrating liquid-based coating has been applied, said apparatus comprising:

a stationary web supporting surface of high thermal conductivity;

means for moving the web over the surface with the uncoated web face in direct contact with said surface;

means for heating said surface to a generally uniform temperature above the boiling point of the coating liquid; and, means for drawing a vacuum through said surface to hold the web in uniform contact therewith during drying.

2. The apparatus as set forth in claim 1 wherein said web supporting surface comprises a plate and said heating means comprises induction heating devices mounted in direct contact with the underside of said plate.

3. The apparatus as set forth in claim 2 wherein said means for drawing a vacuum comprises an array of apertures extending through said plate providing open communication between the web supporting surface and the underside of said plate, and a source of vacuum operatively connected on the underside of said plate to said array.

4. The apparatus as set forth in claim 3 wherein said array of apertures forms a pattern of parallel V-shaped aperture groups opening in the direction of web travel.

5. The apparatus as set forth in claim 4 including shallow grooves formed in the supporting surface, each groove connecting the apertures defining an aperture group.

* * * * *